US010907820B2

(12) United States Patent
Haaf et al.

(10) Patent No.: US 10,907,820 B2
(45) Date of Patent: Feb. 2, 2021

(54) CEILING OR WALL LIGHT HAVING INTEGRATED ELECTRICAL HEATER, FAN AND CONTROL

(71) Applicant: LIQUIDBEAM GmbH, Karlsruhe (DE)

(72) Inventors: Simon Haaf, Karlsruhe (DE); Stefan Grabert, Eggenstein-Leopoldshafen (DE)

(73) Assignee: LIQUIDBEAM GmbH, Karlsruhe (DE)

( * ) Notice: Subject to any disclaimer, the term of this patent is extended or adjusted under 35 U.S.C. 154(b) by 0 days.

(21) Appl. No.: 16/490,729

(22) PCT Filed: Mar. 2, 2018

(86) PCT No.: PCT/EP2018/055172
§ 371 (c)(1),
(2) Date: Sep. 3, 2019

(87) PCT Pub. No.: WO2018/158427
PCT Pub. Date: Sep. 7, 2018

(65) Prior Publication Data

US 2020/0003408 A1 Jan. 2, 2020

(30) Foreign Application Priority Data

Mar. 3, 2017 (DE) ..... 10 2017 002 058

(51) Int. Cl.
*F21V 33/00* (2006.01)
*F21S 8/02* (2006.01)
(Continued)

(52) U.S. Cl.
CPC ..... *F21V 33/0092* (2013.01); *F21S 8/024* (2013.01); *F21S 8/026* (2013.01); *F21S 8/033* (2013.01);
(Continued)

(58) Field of Classification Search
CPC .. F21V 33/0092; F21V 23/0471; F21S 8/024; F21S 8/026; F21S 8/033; F21S 8/04; F24H 3/04; F21Y 2115/10; F24F 2221/02
See application file for complete search history.

(56) References Cited

U.S. PATENT DOCUMENTS 6,352,358 B1 * 3/2002 Lieberman ..... F21V 15/00 362/294
2002/0064380 A1 5/2002 Reiker
(Continued)

FOREIGN PATENT DOCUMENTS

CN 205641114 10/2016
CN 106382677 2/2017

*Primary Examiner* — Bao Q Truong
(74) *Attorney, Agent, or Firm* — Volpe Koenig

(57) ABSTRACT

A ceiling light or wall light having a connection to a typical lighting power circuit, having an integrated heating fan function, and an intelligent control for simple operation and functions for saving energy. In order to avoid a cumbersome variation of the heating possibilities (for example, the installation of a heater, placement of an additional heater, and modification of the control of an existing heater), a replacement of the usually already existing lighting takes over this functionality. The device includes a common housing, that contains at least one lighting element, at least one electrical heating element, at least one fan, and at least one programmable electronic controller, by which the lighting, the fan and the heater are controlled and/or regulated, together with and/or separate from each other. All rooms of a building which have lighting and are to be heated only for a limited period may be part of the area of application.

35 Claims, 3 Drawing Sheets

(51) Int. Cl.

| | |
|---|---|
| ***F21S 8/00*** | (2006.01) |
| ***F21S 8/04*** | (2006.01) |
| ***F21V 23/04*** | (2006.01) |
| ***F24H 3/04*** | (2006.01) |
| *F21Y 115/10* | (2016.01) |

(52) U.S. Cl.
CPC ..... *F21S 8/04* (2013.01); *F21V 23/0471* (2013.01); *F24H 3/04* (2013.01); *F21Y 2115/10* (2016.08); *F24F 2221/02* (2013.01)

(56) References Cited

U.S. PATENT DOCUMENTS

| | | | | |
|---|---|---|---|---|
| 2009/0153057 | A1 | 6/2009 | Cho et al. | |
| 2016/0320069 | A1 | 11/2016 | Hettinger et al. | |
| 2017/0016612 | A1* | 1/2017 | Boyd ..... | F21V 23/003 |

* cited by examiner

CEILING OR WALL LIGHT HAVING INTEGRATED ELECTRICAL HEATER, FAN AND CONTROL

TECHNICAL FIELD

For the short-term heating of small rooms of buildings, electric heaters are often used. An intelligent combination of lighting and electric heating offers many advantages.

BACKGROUND

For lighting interior rooms, LED lights are the current state of the art. For the short-term heating of interior rooms, electric resistance heaters are the current state of the art.

Combinations of heating fans and lights for in-wall (flush) mounting and without integrated control of both functions are also available.

Combinations of IR heating lamps and normal lamps without LED technology, as well as without integrated control of both functions, are available.

DISADVANTAGES OF THE PRIOR ART

Electric heaters are offered according to the prior art as separate on-wall (surface) mount devices for wall or ceiling mounting arrangements. This results in increased space requirements and the necessity of a separate power connection. The lighting and heating are operated separately and offer no integrated function for saving energy. In addition, most thermostats are not very precise with respect to the switch-off temperature.

Existing combinations of electric heaters and lights are given merely as in-wall (flush) devices without LEDs as installed light sources or without fans for circulating the air, as well as without common control.

SUMMARY

The object of the invention is to construct a device that equips a room of a building with a light and also offers the ability to heat the room of a building. The user should be able to operate the device as easily and intuitively as possible. The user should be able to adapt the functions to his or her needs. The installation should be as simple as possible. In addition, functions for saving energy should be integrated.

The objective is achieved by a device having one or more features of the invention. This device with connection to a typical power circuit is characterized in that the device contains, in the common housing, at least one lighting element, at least one electric heating element, at least one fan, and at least one programmable electronic controller by which the lighting, the fan, and the heater can be controlled and/or regulated together and/or separately from each other.

Advantageous constructions of the invention are described below:

For the configuration of the device, the user adapts the light intensity of the device according to his or her needs. The current that flows through the light source or light sources is reduced by the controller. In this way, the light intensity can be adapted to the size of the room, the current use of the room, and personal preferences.

One variation of the heating stages is achieved in that the heater is not operated continuously. Instead, the controller switches the heater on and off in short intervals that cannot be detected by the user. The user specifies the average heating power. The average heating power is preferably in the range between 0.3-3 kW. In this way, the average heating power of the device can be adapted to the size of the room, the current use of the room, and personal preferences.

The intensity of the air flow is configured by the user in different stages. In this way, the air flow can be adapted to the size of the room, the current use of the room, and personal preferences.

The target temperature to be achieved is set by the user. In this way, the target temperature can be adapted for the current use of the room and personal preferences.

Programmable Controller:

The programmable controller enables, in particular, a flexible preconfiguration by the user of variable operating modes and a precise control and/or regulation of all functions of the device.

A time-controlled or event-controlled switching off or reduction of the heater and/or the light saves energy and offers additional safety. The programmable controller contains at least one function for saving energy, which reduces or switches off the light and/or the heater after a time period specified by the user. Alternatively, the heater could also be switched off when the target temperature has been reached at least once. This prevents the user from forgetting to switch off the heater or the light.

The intelligent electronic controller is preferably realized with a microprocessor and shows information with the help of a display. The integrated software (firmware) controls the light intensity, heater, and the fan as a function of internal and external parameters. Various algorithms that process the incoming information are used for this purpose.

Input Variables of the Programmable Controller:

External parameters could be sensor values or also control commands via an interface.

Example sensors could include:

- Temperature(s)
- Air humidity
- Presence (PIR, light barrier, microphone)
- Lighting
- End switch (closed circuits) for monitoring the doors+windows
- Buttons for input of user commands
- Voltage measurement for detecting whether the primary power circuit is still connected to the grid voltage (e.g., for multiple actuation of the power switch for selecting an operating mode)

Example interfaces could include:

- Wired interfaces, e.g., Ethernet
- Wireless interfaces, e.g., ZigBee, infrared, Bluetooth, WLAN Interfaces are useful especially when functions of the device are operated by central offices (e.g., in hotels, youth hostels, residential buildings, on ships).

Internal parameters could be a real-time clock or the results from algorithms and functions implemented in the firmware.

Example internal parameters could include:

- A parameter specification by the user, e.g., the duration of the heating and fan function, the target temperature of the heating function, the light intensity that was stored in non-volatile memory, etc.
- A real-time clock that synchronizes via radio or Ethernet
- Fault algorithm that leads to the shutdown of the device Operating Modes:

The programmable electronic controller enables several different operating modes to be adapted to the user. One operating mode includes preset values with respect to the lighting intensity, the heating function, including target temperature, the fan function, and the time-controlled or event-controlled varying or switching off of both functions, as well as additional parameters. The following examples are preset parameters for an operating mode:

- Display on or off
- Brightness of the display
- Indication of the operating state on the display
- Indication of sensor values on the display
- Changing the units on the display (e.g., temperature in degrees Celsius or Fahrenheit)
- Light intensity after activation
- Light intensity after a defined time has elapsed
- Time switching function for light
- Target temperature after activation
- Value for the hysteresis of the heating function
- Target temperature after a defined time has elapsed
- Time switching function for heater
- Color temperature of the light (mixture of warm white and cold white LEDs)
- Color of the light (for RGB LEDs)

Example for a typical operating mode with time-controlled program sequence:

- The light switch is used to select the operating mode. The light switches on at 50% of maximum brightness. The fan is switched on at 30% of maximum strength. The heater is switched on. This happens within a few seconds.
- After the target temperature has been reached the first time, the heater switches off, the fan continues to run for a few seconds until the heating module has cooled approximately to the ambient temperature. If the measured value falls below the target temperature minus the hysteresis, first the fan switches on again and then the heater.
- After the time period of 30 minutes has elapsed for the heating function, this is switched off on a sustained basis by the intelligent controller.
- After the time period of 60 minutes has elapsed for the light, the light intensity is reduced on a sustained basis to 15%.
- The current state for the heater, fan, and light is maintained until a new operating mode is selected.

Example for a typical operating mode with event-controlled program sequence:

- The light switch is used to select the operating mode. The light switches on at 50% of maximum brightness. The fan is switched on at 30% of the maximum strength. The heater is switched on. This happens within a few seconds.
- After the target temperature has been reached the first time, the heater switches off, the fan continues to run for a few seconds until the heating module has cooled approximately to the ambient temperature. If the measured value falls below the target temperature minus the hysteresis, first the fan switches on again and then the heater.
- After the target temperature has been reached the fifth time, the heater switches off on a sustained basis. The fan continues to run for a few seconds until the heating module has cooled approximately to the ambient temperature.
- The current state for the heater, fan, and light is maintained until a new operating mode is selected.

Control of the Device by the User:

For the control by the user, in the simplest case, the actuation of the light switch is sufficient. For example, it is possible to select the operating mode by actuating the light switch multiple times or by varying the actuation of the light switch in terms of time. If the light switch is actuated normally, the first operating mode is selected.

For selecting the next operating mode, the light switch is switched off again and, e.g., switched on again within a certain time period. By repeating this process additional times, additional operating modes are selected.

Alternatively, the time between the first switching off and the new switching on of the light switch could be used for selecting the operating mode.

As other possible interfaces for control, wired or wireless interfaces could be used.

In this way, the programmable controller realizes an especially simple and nevertheless very convenient mode of controlling the device.

Power Supply:

In the simplest case, only the power connection for the ceiling light is needed. With at least one additional connection, functions such as heating and ventilation or freeze protection monitoring can be activated through a central system. In this way, e.g., in hotels, in the summertime, the heating function could be deactivated or, in the wintertime, a freezing protection monitoring function could be activated.

Materials:

With respect to the selection of materials, there are no special requirements. The materials for housing parts must satisfy only the demands on manufacturability, fire safety, corrosion resistance, electrical insulation, heat conductance, and temperatures. The diffuser must also fulfill the appropriate optical requirements.

The components that are named above and claimed and described in the embodiments and to be used according to the invention are not subject to any special exceptional conditions in terms of their size, shape, construction, selection of materials, and technical designs, so that they could find unlimited use in the area of application for known selection criteria.

The components are connected to each other, for example, by screws, clips, rivets, adhesive bonds, clamps, pressing, clinching, welding.

Advantages of the Invention

Due to the device according to the invention, there is not a need to operate two separate devices.

The intelligent controller enables a precise regulation of the electric heater and thus enables the desired target temperature to be reached exactly.

The intelligent controller enables a precise adaptation of the light intensity to the size of the room and the preferences of the user.

The intelligent controller enables a precise adaptation of the average heating power to the size of the room and the preferences of the user.

The intelligent controller enables a precise adaptation of the air flow to the size of the room and the preferences of the user.

The intelligent controller enables a precise setting of the hysteresis of the heating function to the size of the room.

By selecting different operating modes, the function can be adapted to the desires of the user.

Through the configuration of the operating modes, the functions can be adapted to the space and to the preferences of the user.

A time-controlled or event-controlled switching off or reducing of the heating and/or the light saves energy and offers additional safety.

A use of existing concealed wiring is possible.

The fixed mounting prevents theft.

The mounting on the ceiling or wall is an especially space-saving and safe arrangement.

Tripping over cables on the floor is not possible.

Tipping over or unintentionally covering the heater, e.g., with articles of clothing or blankets, is no longer possible.

The device according to the invention enables simple mounting, because an existing power circuit can be used.

The operation by the light switch is very convenient and simple and can be used by the binary state change of the button within time-limited switching sequences for selecting different preset values.

The optional connection to additional interfaces enables the convenient control of multiple devices from one central point.

BRIEF DESCRIPTION OF THE DRAWINGS

The invention will be explained in more detail below with reference to an exemplary embodiment shown in the drawings.

Shown are.

DETAILED DESCRIPTION

Figure 1:
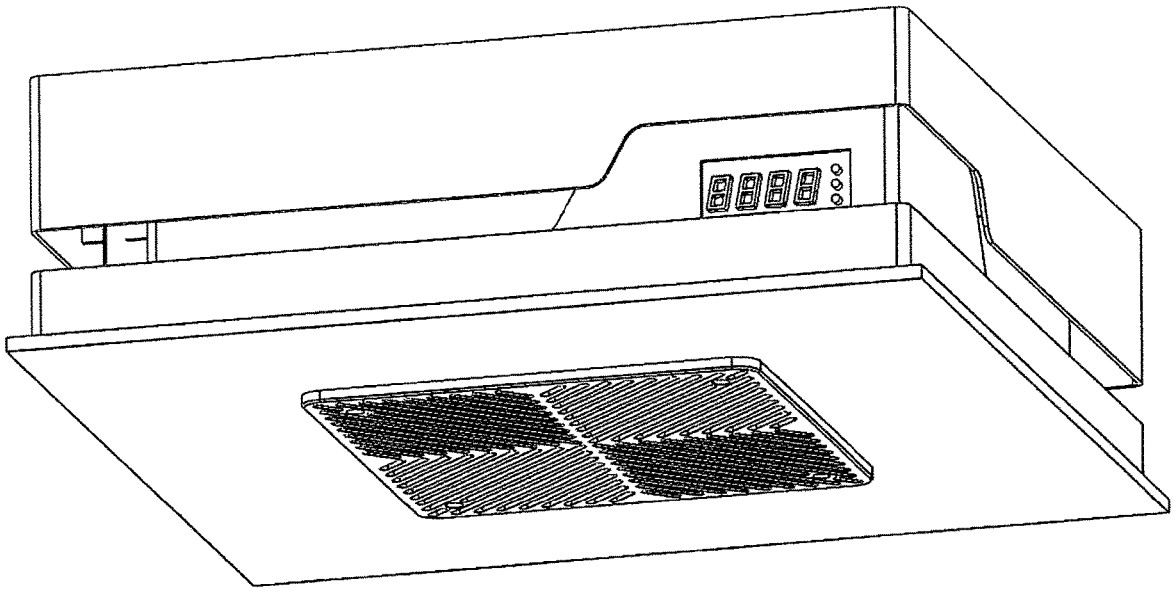
FIG. 1: device in its entirety.

FIG. 1 shows the device in its entirety, as it would be later mounted, for example, on a ceiling.

Figure 2:
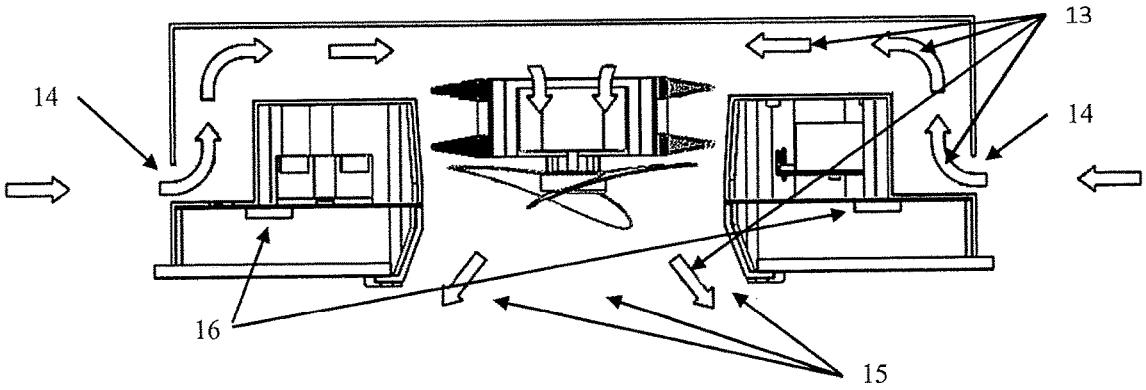
FIG. 2: simplified section view through the device.

FIG. 2 shows a simplified section view through the device. While the fan is operating, the air flow (13) is guided with the help of the mounting enclosure (1) and the housing parts (6, 10, 12) from the air inlet (14) through the heater (4) and the fan (5) to the air outlet (15).

This guiding of the air flow (13) provides, in particular, that the air taken in does not flow directly along the mounting surface and causes soiling there.

Figure 3:
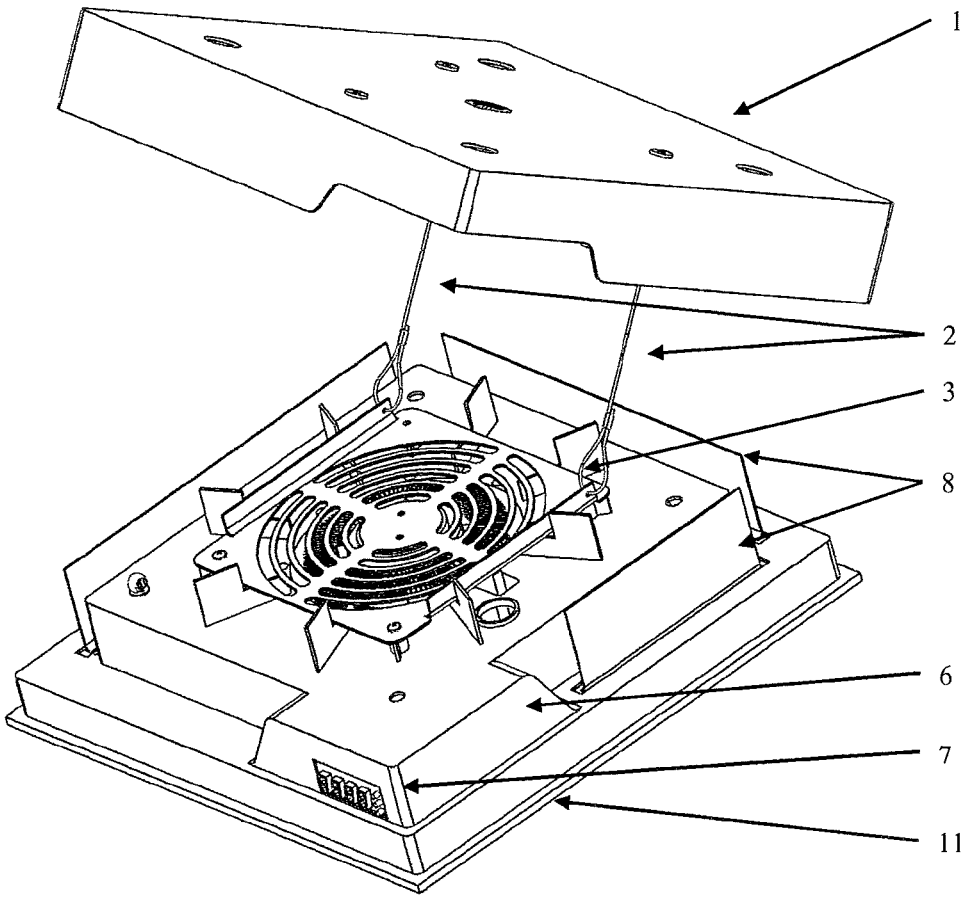
FIG. 3: device in the state of assembly or maintenance/servicing.

FIG. 3 shows the device in the state of assembly or maintenance/servicing. The mounting enclosure (1) is used for mounting the device, e.g., on the ceiling. In addition, the threaded connection fasteners of the electronic connection are housed in the mounting enclosure and the two retaining cords (2) are attached to the mounting enclosure (1). The two retaining cords (2) enable convenient and safe handling during the assembly or maintenance/servicing of the device.

Also visible in FIG. 3 are the housing part A (6) with the projecting parts of the aluminum sheet plate (8) and the contact protection A (3) that is simultaneously used as a carrier for the heater and fan. Also to be seen is the display with the buttons, which are mounted on the controller circuit board (7) of the device. The upper part of the housing, that is, housing part A (6) and the mounting enclosure (1) are connected to each other by a positive-fit and/or non-positive fit locking connection, which is to be opened or closed by the installer.

Figure 4:
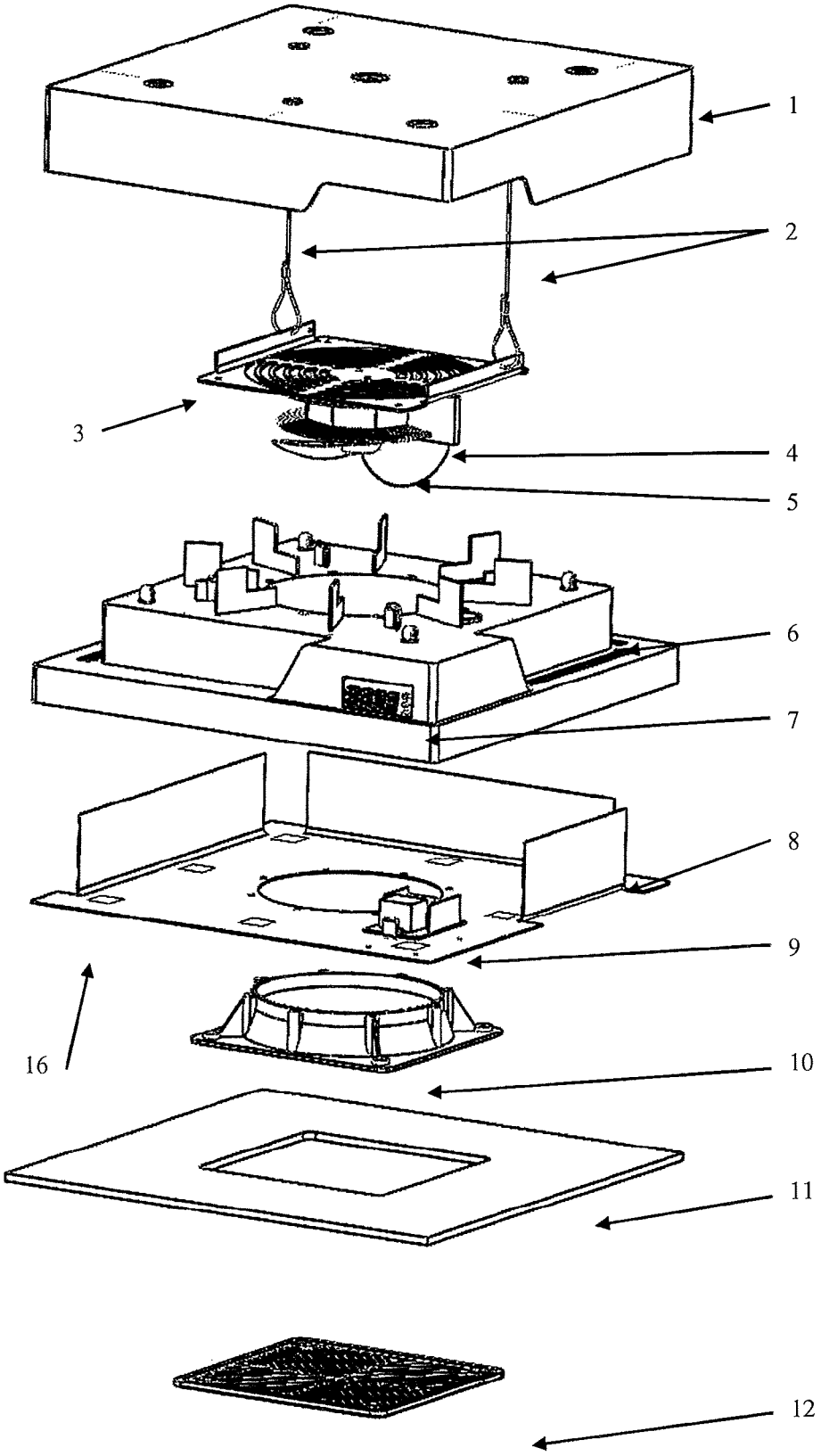
FIG. 4: simplified exploded-view drawing of the entire device.

The fan (5) shown in FIG. 4 and the heater (4) provide for the heating and transport of the air. The housing (1, 6, 10, 11, 12) is used for protecting the electronics from contact, soiling, moisture, and insects, and also for mounting the fan and the heater.

The aluminum sheet plate (8) is used for mounting the electronics (7, 9) and the LEDs (16) and also for cooling the electronics (7, 9) and the LEDs (16).

The diffuser (11) is part of the housing and sits approx. 20 mm away from the aluminum sheet plate (8). It contributes to sealing the housing and provides for a uniform scattering of the light.

The contact protection A (3) and the contact protection B (12) are used for protecting against contact with the heater (4) and the fan (5). Both parts also guide the air flow (13).

The supply of power for the LEDs (16) and the controller electronics (7) within the device is guaranteed by the power supply (9). The electronic controller (7) is based on a microcontroller that controls the heating function, the ventilation, the display, and the LEDs.

For configuring the various operating modes, a man-machine interface is used that is realized in this embodiment by a display and three buttons (7). The operating mode is selected in this embodiment by actuating the light switch once or multiple times.

In this embodiment, the display is realized by four so-called 7-segment displays that show, during operation, the current temperature or the time remaining for the heating function or other information, for example, in an alternating cycle.

For switching the heater, a semiconductor relay is preferably used. The ventilation (5) is realized with the help of a brushless DC motor with matching control system.

LIST OF REFERENCE SYMBOLS

1. Mounting enclosure
2. Retaining cord
3. Contact protection A
4. Heater
5. Fan
6. Housing part A
7. Controller with display and buttons
8. Aluminum sheet plate
9. Installed power supply
10. Housing part B
11. Diffuser
12. Contact protection B
13. Air flow
14. Air inlet
15. Air outlet
16. LED

The invention claimed is:

1. A ceiling or wall light adapted for connection to a typical power circuit, the ceiling or wall light comprising: a common housing (1, 6, 10, 11), at least one lighting element (16), at least one electrical heating element (4), at least one fan (5), and a programmable electronic controller (7) in the common housing, the programmable electronic controller (7) being configured to at least one of control or regulate the lighting element, the fan, and the at least one electrical heating element (4) together or separately from each other, and the ceiling or wall light is controllable by repeatedly switching the light circuit on and off, or by a time-varying sequence of at least two switching operations of the light circuit, a selection of an operating mode being effected by multiple actuation of a light switch of the light circuit or temporal variance in the actuation of the light switch.

2. The ceiling or wall light according to claim 1, wherein the ceiling or wall light is configured for on-wall surface mounting.

3. The ceiling or wall light according to claim 1, wherein the ceiling or wall light is configured for in-wall flush mounting.

4. The ceiling or wall light according to claim 1, further comprising at least one temperature sensor.

5. The ceiling or wall light according to claim 1, further comprising at least one LED as the at least one lighting element (16).

6. The ceiling or wall light according to claim 1, further comprising at least one optical display (7) that shows information for display.

7. The ceiling or wall light according to claim 1, further comprising at least one acoustic signal that signals information.

8. The ceiling or wall light according to claim 1, further comprising at least one intake opening (14) that has a minimum distance of 1 mm to a mounting surface, in order to prevent soiling of the mounting surface.

9. The ceiling or wall light according to claim 1, wherein the ceiling or wall light is configured to be at least one of controlled or regulated by at least one light barrier.

10. The ceiling or wall light according to claim 1, wherein the ceiling or wall light is configured to be at least one of controlled or regulated by at least one motion detector.

11. The ceiling or wall light according to claim 1, wherein the ceiling or wall light is configured to be at least one of controlled or regulated by at least one hygrometer.

12. The ceiling or wall light according to claim 1, wherein the ceiling or wall light is configured to be at least one of controlled or regulated by at least one microphone.

13. The ceiling or wall light according to claim 1, wherein the ceiling or wall light is configured to be at least one of controlled or regulated by at least one clock.

14. The ceiling or wall light according to claim 1, further comprising at least one additional power connection that enables a heating function independent of the lighting.

15. The ceiling or wall light according to claim 1, further comprising guide elements through which the air flow (13) is guided in a preferred direction at an air outlet (15).

16. The ceiling or wall light according to claim 1, wherein a light color of the at least one lighting element is changeable.

17. The ceiling or wall light according to claim 1, wherein a color temperature of white light from the at least one lighting element is changeable.

18. The ceiling or wall light according to claim 1, further comprising at least one additional power connection that enables the at least one electrical heating element (4) to be switched on only as a function of a second power circuit.

19. The ceiling or wall light according to claim 1, wherein the ceiling or wall light is configured to change its own state by a program as a function of at least one internal input variable such that at least one of the controllable functions can be changed.

20. The ceiling or wall light according to claim 1, wherein the ceiling or wall light changes its own state by a program as a function of at least one external input variable such that at least one of the controllable functions is changed.

21. The ceiling or wall light according to claim 1, wherein the programmable electronic controller (7) comprises at least one microcontroller.

22. The ceiling or wall light according to claim 1, wherein the programmable electronic controller (7) comprises at least one clocked processor.

23. The ceiling or wall light according to claim 1, further comprising at least one non-volatile memory.

24. The ceiling or wall light according to claim 1, further comprising at least one firmware unit.

25. The ceiling or wall light according to claim 1, further comprising at least one of an internal battery or accumulator that enables at least one of a configuration, operation or function of an internal clock independent of an electric power grid.

26. The ceiling or wall light according to claim 1, wherein the programmable electronic controller is configured to change a light intensity in at least 5 steps.

27. The ceiling or wall light according to claim 1, further comprising at least one interface, button (7), or display (7).

28. The ceiling or wall light according to claim 1, wherein the ceiling or wall light is adapted to be configured by the user.

29. The ceiling or wall light according to claim 1, wherein the ceiling or wall light has at least two different operating modes that are adapted to be selected by the user.

30. The ceiling or wall light according to claim 1, wherein the ceiling or wall light is configured to execute time-controlled program sequences.

31. The ceiling or wall light according to claim 1, wherein the ceiling or wall light is configured to execute event-controlled program sequences.

32. The ceiling or wall light according to claim 1, wherein the ceiling or wall light includes at least one function for saving energy.

33. The ceiling or wall light according to claim 1, wherein the at least one fan (5) includes a brushless DC motor.

34. The ceiling or wall light according to claim 1, wherein the at least one electrical heating element includes at least one electric resistance heater (4).

35. The ceiling or wall light according to claim 1, further comprising a semiconductor component that switches the at least one electrical heating element (4).

* * * * *